US005355980A

United States Patent [19]

Hsieh

[11] Patent Number: 5,355,980

[45] Date of Patent: Oct. 18, 1994

[54] SUITCASE WITH EXTENSIBLE HANDLE AND FOLDABLE PLATE FOR CARRYING ANOTHER SUITCASE THEREON

[76] Inventor: Dick M. Hsieh, No. 18, Lane 777, Chung-Shan Rd., Kuei-Jen Hsiang, Tainan Hsien, Taiwan

[21] Appl. No.: 119,760

[22] Filed: Sep. 10, 1993

[51] Int. Cl.[5] ..... A45C 5/14

[52] U.S. Cl. ..... 190/115; 190/18 A; 242/384.7

[58] Field of Search ..... 119/115, 18 A, 39; 242/107.4 R; 16/115

[56] References Cited

U.S. PATENT DOCUMENTS

| | | | |
|---|---|---|---|
| 4,261,447 | 4/1981 | Arias et al. | 190/18 A |
| 4,340,132 | 7/1982 | Cerna | 190/18 A |
| 4,597,546 | 7/1986 | Yamamoto et al. | 242/107.4 R X |
| 4,759,431 | 7/1988 | King et al. | 190/115 X |
| 4,792,025 | 12/1988 | Thomas | 190/18 A |
| 5,253,739 | 10/1993 | King | 190/115 X |

FOREIGN PATENT DOCUMENTS

| | | | |
|---|---|---|---|
| 2168035 | 6/1986 | United Kingdom | 190/18 A |

*Primary Examiner*—Allan N. Shoap
*Assistant Examiner*—Christopher J. McDonald

[57] ABSTRACT

A suitcase includes a hollow suitcase body which has a front side wall, a rear side wall that is formed with a longitudinally extending recess, and a wheel unit that is mounted on a lower end portion of the rear side wall. A foldable plate is mounted pivotally on the front side wall and is turnable outward to a carrying position in which the foldable plate is generally perpendicular to the front side wall. A cover plate is mounted on the rear side wall to cover the recess. A strap mounting frame is mounted on an inner face of the cover plate and has a top portion provided with a horizontally extending first hook support, a rotatable shaft, and a strap wound on the shaft and having one end fixed thereto. A handle member has two upright tubular portions which are inserted slidably into two upright tubular sleeves formed on the inner face of the cover plate. The handle member further has a horizontal second hook support extending across distal top ends of the tubular portions. The strap has a distal end which is provided with a hook unit that engages removably the first hook support when the strap is wound fully on the rotatable shaft. The hook unit engages removably the second hook support after the strap is pulled to bind an object carried on the foldable plate.

2 Claims, 5 Drawing Sheets

SUITCASE WITH EXTENSIBLE HANDLE AND FOLDABLE PLATE FOR CARRYING ANOTHER SUITCASE THEREON

BACKGROUND OF THE INVENTION

1. Field of the Invention

The invention relates to a suitcase, more particularly to a wheeled suitcase with an extensible handle and a foldable plate for carrying another suitcase thereon.

2. Description of the Related Art

A conventional suitcase is provided with wheels to facilitate transport of the same. In some cases, a traveler has to carry a briefcase in addition to the suitcase. It is inconvenient for a traveler to carry the suitcase and the briefcase altogether.

SUMMARY OF THE INVENTION

The objective of the present invention is to provide a wheeled suitcase with an extensible handle and a foldable plate for carrying another suitcase thereon.

Accordingly, the suitcase of the present invention comprises:

a hollow suitcase body having a front side wall, a rear side wall which has a lower portion and which is formed with a longitudinally extending recess, and a wheel unit mounted on the lower end portion of the rear side wall;

a foldable plate mounted pivotally on the front side wall of the suitcase body and turnable outward to a carrying position in which the foldable plate is generally perpendicular to the front side wall;

a cover plate mounted on the rear side wall of the suitcase body to cover the recess, the cover plate having an inner face formed with a spaced pair of upright tubular sleeves, each of the upright tubular sleeves having a top portion that is formed with a radial hole, the cover plate being formed with a pair of elongated slots and a bent top portion with an opening;

a strap mounting frame mounted on the inner face of the cover plate, the strap mounting frame having a top portion provided with a horizontally extending first hook support, a bottom portion provided with a spaced pair of pivot ears, a shaft extending between the pivot ears and being mounted rotatably thereto, a strap wound on the shaft and having one end fixed thereto, a toothed positioning wheel provided on one end of the shaft, a first spring means for biasing the shaft in a direction for winding the strap thereon, a pivot seat mounted pivotally on the strap mounting frame and having a bottom end formed with a stop projection that engages releasably the positioning wheel to arrest rotation of the shaft, and a second spring means for biasing the pivot seat toward the strap mounting frame, the pivot seat further having a top end which is formed with a lever portion that extends out of the opening in the bent top portion of the cover plate and that is operated to cause the pivot seat to pivot against action of the second biasing means in order to disengage the stop projection from the positioning wheel; and a handle member having two upright tubular portions, each of which being formed with a series of longitudinally aligned positioning holes and being inserted slidably into the upright tubular sleeves on the cover plate, the handle member further having a horizontal second hook support extending across distal top ends of the tubular portions;

the strap mounting frame further having a pair of slide plates mounted slidably thereon and extending through a respective one of the elongated slots of the cover plate, each of the slide plates having an outermost end formed with a locking pin, and a third spring means for biasing the slide plates away from each other, the locking pin of each of the slide plates extending releasably into the radial hole of a respective one of the upright tubular sleeves and into a selected one of the positioning holes in a respective one of the tubular portions to retain the handle member at a desired degree of extension relative to the suitcase body;

the strap having a distal end which is provided with a hook unit that engages removably the first hook support on the strap mounting frame when the strap is wound fully around the shaft on the strap mounting frame, the hook unit engaging removably the second hook support on the handle member after the strap is pulled to bind an object carried on the foldable plate.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
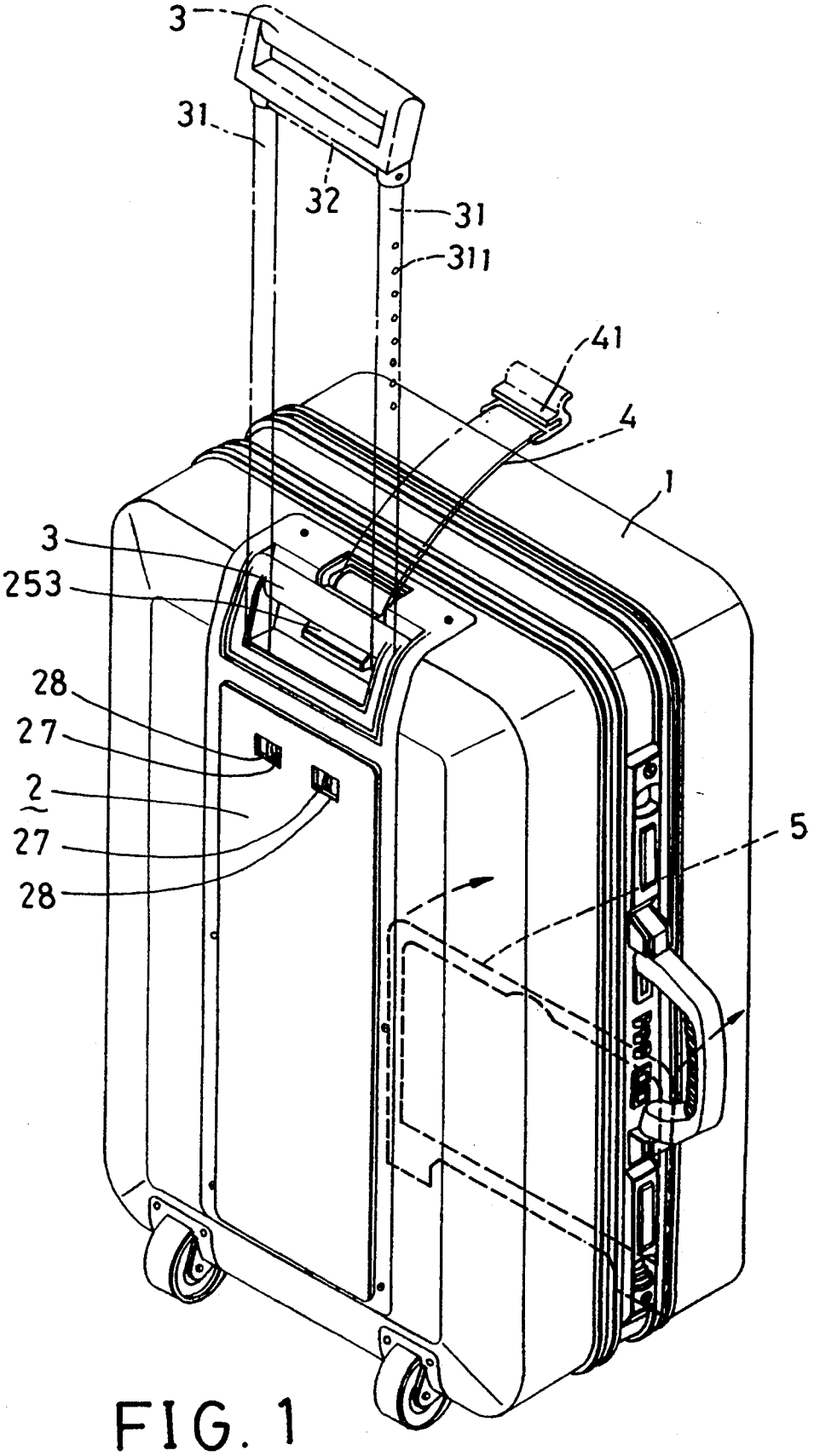
FIG. 1 is a perspective view of the preferred embodiment of a suitcase according to the present invention.
Figure 2:
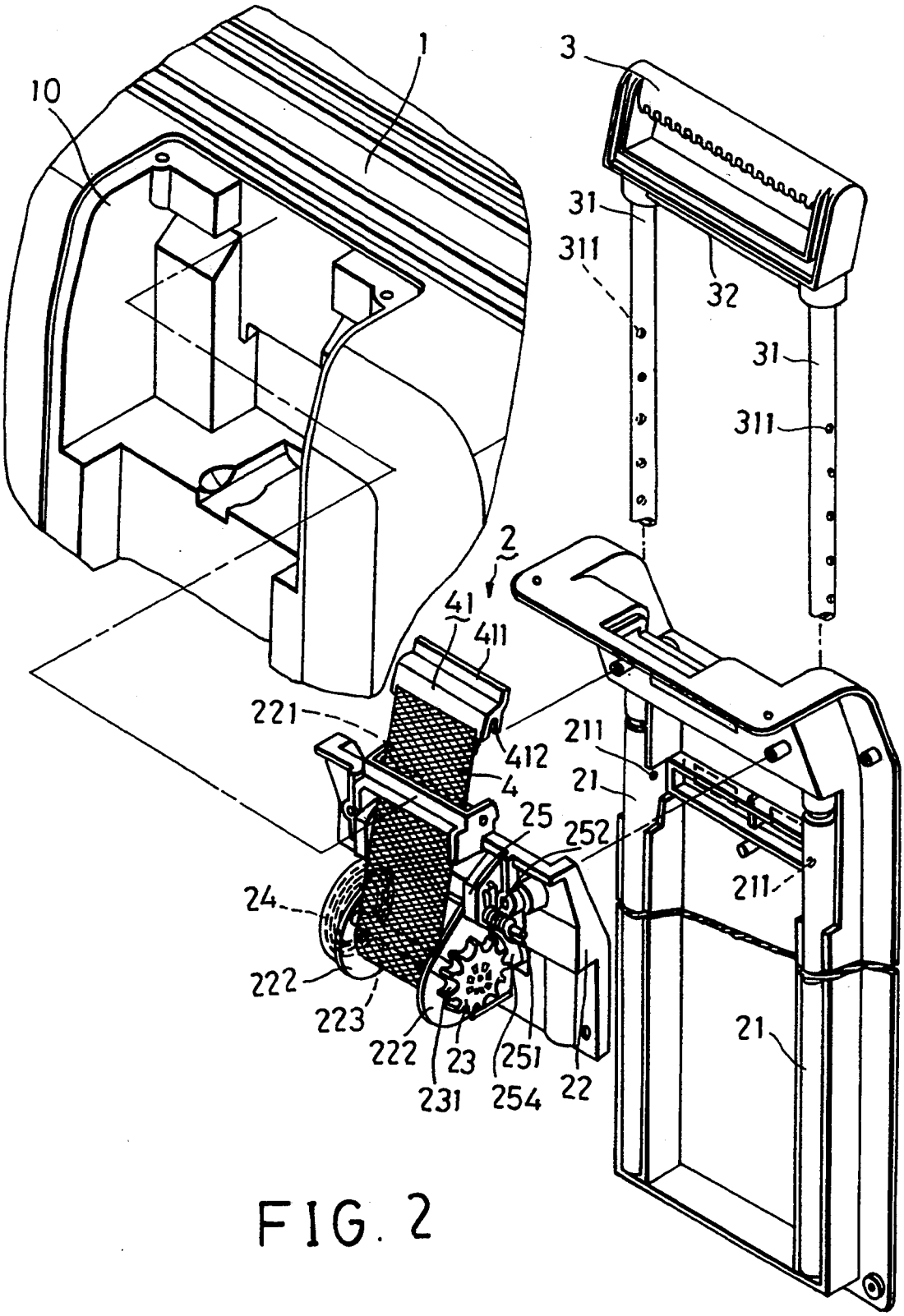
FIG. 2 is a fragmentary exploded view illustrating a handle member and a strap mounting frame of the preferred embodiment.

Referring to FIGS. 1 and 2, the preferred embodiment of a suitcase according to the present invention is shown to comprise a hollow suitcase body 1, a handle member 3, a strap 4 and a biased foldable plate 5.

The suitcase body 1 has a rear side wall which is formed with a longitudinally extending recess 10. A cover plate 2 is mounted on the rear side wall of the suitcase body 1 to cover the recess 10. The cover plate 2 has an inner face which is formed with a spaced pair of upright tubular sleeves 21. A strap mounting frame 22 is mounted on the inner face of the cover plate 2 adjacent to a top end of the latter. The strap mounting frame 22 is disposed between the upright tubular sleeves 21 and has a top portion which is provided with a horizontally extending first hook support 221. The strap mounting frame 22 further has a bottom portion which is provided with a spaced pair of pivot ears 222. A shaft 223 extends between the pivot ears 222 and is mounted rotatably thereto. The strap 4 has one end fixed to the shaft 223 and is wound thereon. A toothed positioning wheel 23 and a spiral spring 24 are provided respectively on two ends of the shaft 223. The spiral spring 24 biases the shaft 223 so as to wind the strap 4 thereon. A pivot seat 25 is mounted pivotally on upper parts of the pivot ears 222 by means of a pivot pin 251. A torsion spring 252 is disposed on one end of the pivot pin 251 and serves to bias the pivot seat 25 toward the strap mounting frame 22. The pivot seat 25 has a lever portion 253 which is formed on a top end and which extends out of an opening that is formed in a bent top portion of the cover plate 2. The pivot seat 25 further has a bottom end which is formed with a stop projection 254 for engaging one of the notches 231 of the positioning wheel 23 when a desired length of the strap 4 has been unwound from the shaft 223 against action of the spiral spring 24.

Figure 3:
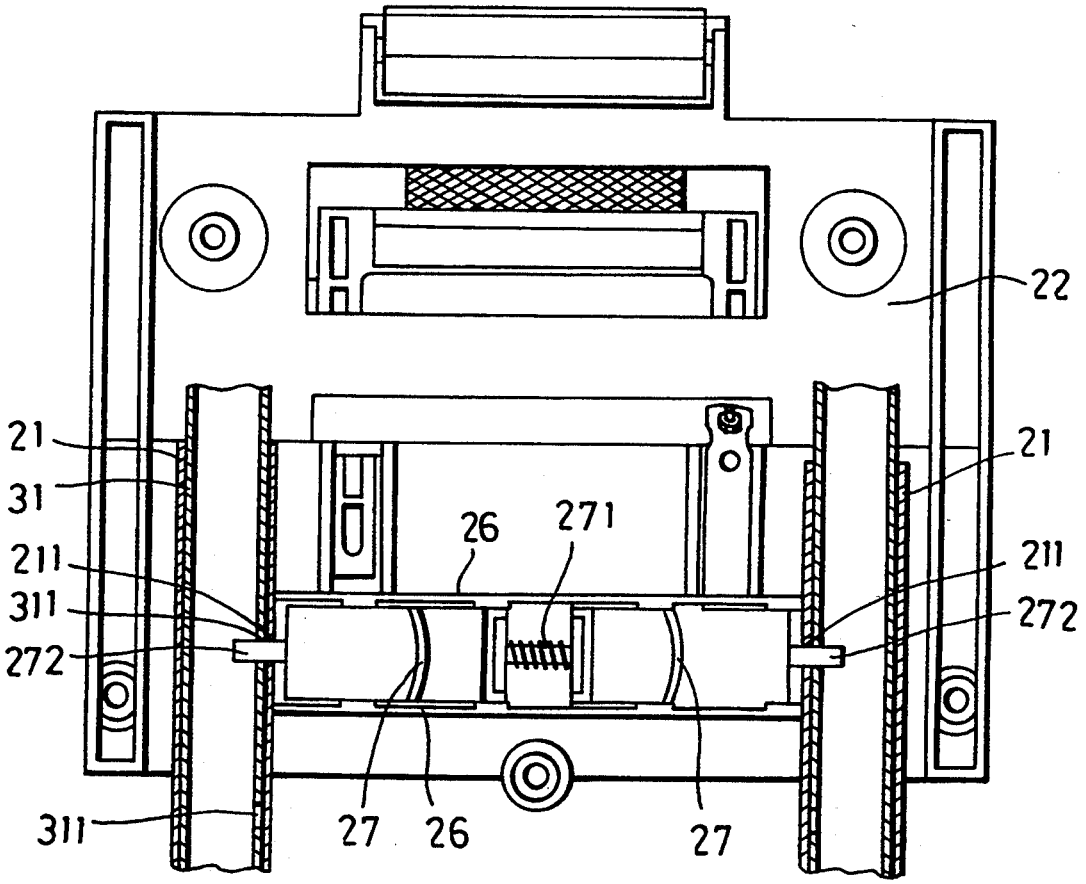
FIG. 3 is a fragmentary sectional view illustrating a handle retaining unit of the strap mounting frame of the preferred embodiment.

Referring to FIG. 3, the strap mounting frame 22 has an outer face which is formed with a pair of slide rails 26. A pair of slide plates 27 are mounted slidably on the slide rails 26. The cover plate 2 is formed with a pair of elongated slots 28 which permit a respective one of the slide plates 27 to extend movably therethrough. Each of the slide plates 27 has an outermost end which is formed with a locking pin 272. A helical spring 271 is provided between the innermost ends of the slide plates 27 and serves to bias the slide plates 27 away from each other. Each of the upright tubular sleeves 21 has a top portion that is formed with a radial hole 211. During normal conditions, the locking pin 272 of each slide plate 27 extends into the radial hole 211 of a respective upright tubular sleeve 21.

Referring once more to FIG. 2, the handle member 3 has two upright tubular portions 31. Each of the tubular portions 31 is formed With a series of longitudinally aligned positioning holes 311. A horizontal second hook support 32 extends across distal top ends of the tubular portions 31. The tubular portions 31 of the handle member 3 are inserted into the upright tubular sleeves 21 on the cover plate 2. The locking pin 272 of each slide plate 27 extends into one of the positioning holes 311 in the respective tubular portion 31, thereby retaining the handle member 3 at a desired degree of extension relative to the suitcase body 1 in order to suit the user's needs.

Figure 4:
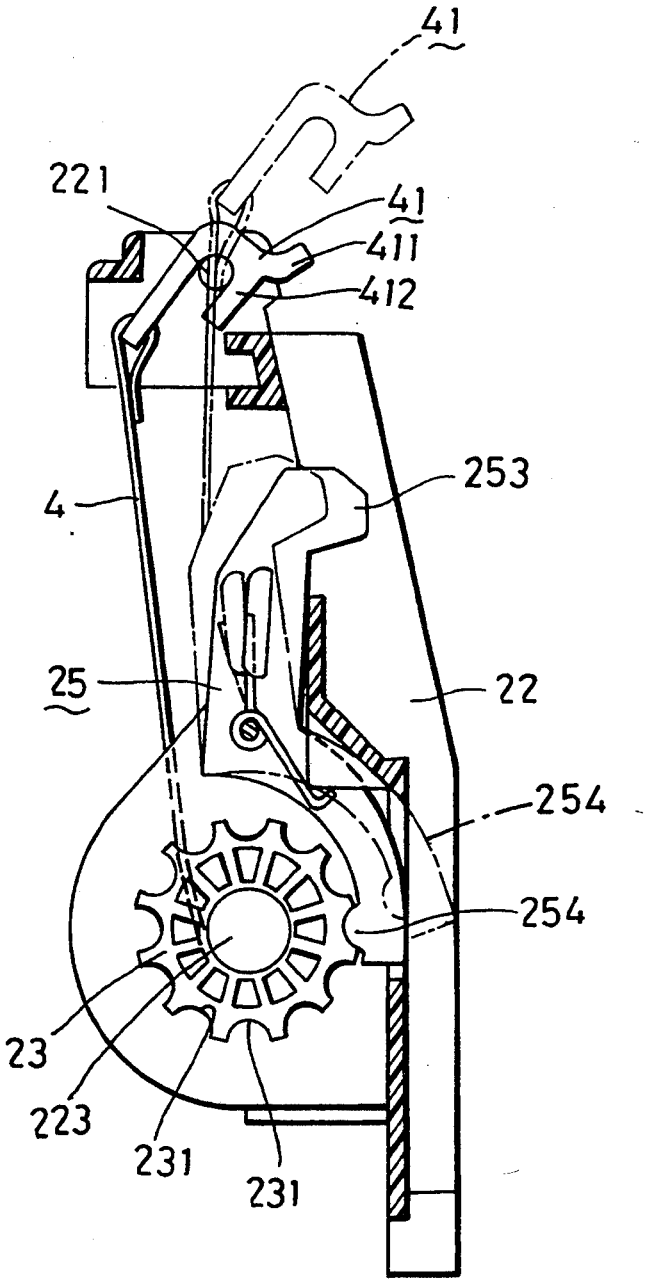
FIG. 4 is a schematic view illustrating the strap mounting frame of the preferred embodiment.

Referring to FIGS. 2 and 4, the strap 4 has a distal end which is provided with a hook unit 41. The hook unit 41 is formed with a downwardly opening hook portion 412 and a pull portion 411 which extends upwardly from the hook portion 412. Initially, when the strap 4 is wound fully around the shaft 223 on the strap mounting frame 22, the hook portion 412 engages the first hook support 221 on the strap mounting frame 22. When it is desired to pull the strap 4, the lever portion 253 of the pivot seat 25 is operated in order to disengage the stop projection 254 from the positioning wheel 23, as indicated by the phantom lines in FIG. 4. When the strap 4 is pulled, the shaft 223 and the positioning wheel 23 rotate, while the spiral spring 24 is wound in order to provide the necessary force to restore the strap 4 to a fully wound position on the shaft 223 when desired.

Figure 5:
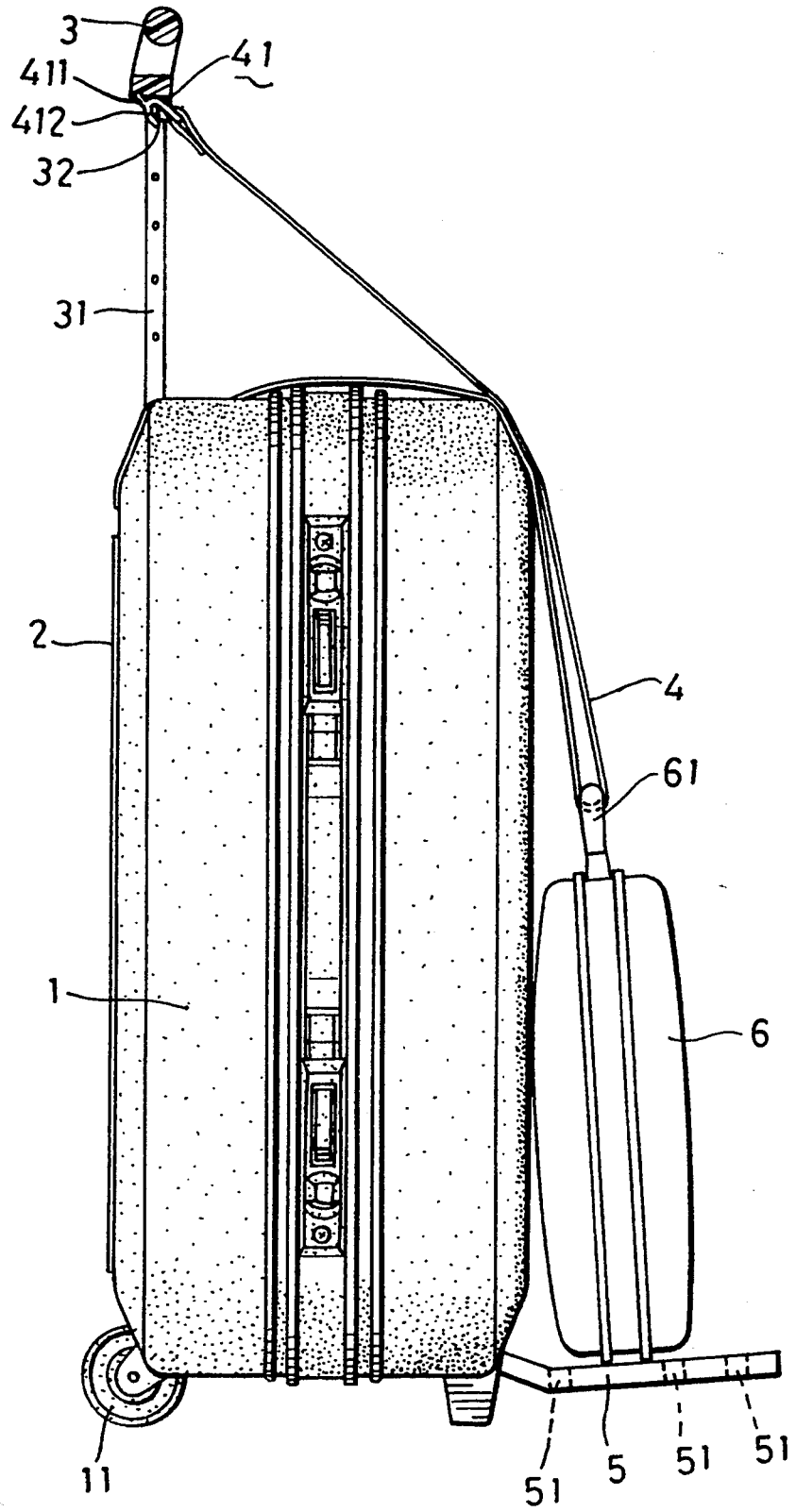
FIG. 5 is a schematic view illustrating the preferred embodiment when in use.

Referring to FIG. 5, the foldable plate 5 is mounted pivotally on a front side wall of the suitcase body 1 and is turnable outward to a carrying position in which the foldable plate 5 is perpendicular to the front side wall of the suitcase body 1 so as to carry another suitcase, such as a briefcase 6, thereon.

Wheels 11 are mounted on a lower end portion of the rear side wall of the suitcase body 1 to facilitate transport of the suitcase of the present invention. When carrying an object, such as the briefcase 6, on the foldable plate 5, the strap 4 is pulled over the top portion of the suitcase body 1, through the handle 61 of the briefcase 6, and is then pulled toward the handle member 3 so that the hook portion 412 can engage the second hook support 32 on the handle member 3. The briefcase 6 is bound to the suitcase of the present invention at this stage.

In addition, the foldable plate 5 is formed with a plurality of spaced through holes 51. The strap 4 is extended through selected two of the through holes 51 when binding an object to the suitcase of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A suitcase, comprising:

a hollow suitcase body having a front side wall, a rear side wall which has a lower portion and which is formed with a longitudinally extending recess, and a wheel unit mounted on said lower end portion of said rear side wall;

a foldable plate mounted pivotally on said front side wall of said suitcase body and turnable outward to a carrying position in which said foldable plate is generally perpendicular to said front side wall;

a cover plate mounted on said rear side wall of said suitcase body to cover said recess, said cover plate having an inner face formed with a spaced pair of upright tubular sleeves, each of said upright tubular sleeves having a top portion that is formed with a radial hole, said cover plate being formed with a pair of elongated slots and a bent top portion with an opening;

a strap mounting frame mounted on said inner face of said cover plate, said strap mounting frame having a top portion provided with a horizontally extending first hook support, a bottom portion provided with a spaced pair of pivot ears, a shaft extending between said pivot ears and being mounted rotatably thereto, a strap wound on said shaft and having one end fixed thereto, a toothed positioning wheel provided on one end of said shaft, a first spring means for biasing said shaft in a direction for winding said strap thereon, a pivot seat mounted pivotally on said strap mounting frame and having a bottom end formed with a stop projection that engages releasably said positioning wheel to arrest rotation of said shaft, and a second spring means for biasing said pivot seat toward said strap mounting frame, said pivot seat further having a top end which is formed with a lever portion that extends out of said opening in said bent top portion of said cover plate and that is operated to cause said pivot seat to pivot against action of said second biasing means in order to disengage said stop projection from said positioning wheel; and a handle member having two upright tubular portions, each of which being formed with a series of longitudinally aligned positioning holes and being inserted slidably into said upright tubular sleeves on said cover plate, said handle member further having a horizontal second hook support extending across distal top ends of said tubular portions;

said strap mounting frame further having a pair of slide plates mounted slidably thereon and extending through a respective one of said elongated slots of said cover plate, each of said slide plates having an outermost end formed with a locking pin, and a third spring means for biasing said slide plates away from each other, said locking pin of each of said slide plates extending releasably into said radial hole of a respective one of said upright tubular sleeves and into a selected one of said positioning holes in a respective one of said tubular portions to retain said handle member at a desired degree of extension relative to said suitcase body;

said strap having a distal end which is provided with a hook unit that engages removably said first hook support on said strap mounting frame when said strap is wound fully around said shaft on said strap mounting frame, said hook unit engaging removably said second hook support on said handle member after said strap is pulled to bind an object carried on said foldable plate.

2. The suitcase as claimed in claim 1, wherein said foldable plate is formed with a plurality of spaced through holes to permit passage of said strap therethrough when the object is bound.

* * * * *